US005287568A

United States Patent [19]

Mohrmann

[11] Patent Number: 5,287,568

[45] Date of Patent: Feb. 22, 1994

[54] TILT LIFT BATHING SYSTEM

[76] Inventor: Gene D. Mohrmann, 224 SE. Calle Columbo, Columbus, Nebr. 68601

[21] Appl. No.: 986,623

[22] Filed: Dec. 7, 1992

[51] Int. Cl.[5] ..... A47K 3/12

[52] U.S. Cl. ..... 4/561.1; 4/562.1; 4/565.1; 4/496

[58] Field of Search ..... 4/546, 560, 561, 562, 4/563, 577, 578, 579, 564, 496; 297/326, 329, 349

[56] References Cited

U.S. PATENT DOCUMENTS

| | | | |
|---|---|---|---|
| 2,697,475 | 12/1954 | Dueth | 155/36.5 |
| 3,104,399 | 9/1963 | Dalton | 4/562.1 |
| 3,852,835 | 12/1974 | Whitaker | 4/562.1 |
| 3,879,770 | 4/1975 | Grant | 4/185 |
| 4,091,478 | 5/1978 | Hardwick et al. | 4/185 |
| 4,128,904 | 12/1978 | Ekman et al. | 4/185 |
| 4,206,523 | 6/1980 | James | 4/562.1 |
| 4,211,216 | 7/1980 | Burgess et al. | 128/66 |
| 4,285,416 | 8/1981 | Dudynskyj | 187/9 |
| 4,552,348 | 11/1985 | Forssmann et al. | 269/324 |
| 4,574,408 | 3/1986 | Dentler et al. | 4/560 |
| 4,885,810 | 12/1989 | Unger et al. | 4/496 |
| 5,040,939 | 8/1991 | Booth | 414/678 |

*Primary Examiner*—Henry J. Recla
*Assistant Examiner*—Gregory Vidovich
*Attorney, Agent, or Firm*—John A. Beehner

[57] ABSTRACT

A tilt lift bathing system includes a central support having a chair mounted thereon for pivotal movement about a horizontal pivot axis between a lowered upright position adjacent one side of the central support and a raised recumbent position above the central support. The chair is rotatable about a vertical axis in its raised recumbent position so that upon mounting of the central support adjacent one wall of a bathtub, the chair is pivotable upwardly by a powered device to the raised recumbent position rotatable over the tub wall and pivotable downwardly to the lowered upright position in the tub for bathing an occupant of the chair.

18 Claims, 7 Drawing Sheets

TILT LIFT BATHING SYSTEM

BACKGROUND OF THE INVENTION

1. Technical Field

This invention relates to bathing systems to assist the elderly or infirm and, more particularly, to a tilt lift bathing system having a chair positioned adjacent one end of a bathing vessel or tub, the chair being tilted upwards about a substantially horizontal pivot axis to provide sufficient clearance to allow the chair to be rotated to a position above the tub for lowering the occupant into the tub.

2. Description of the Prior Art

To the elderly or infirm, the act of bathing can present serious difficulties as it is often difficult or impossible for such persons to enter or exit a bathing vessel without some form of assistance. Even with such help, entering and exiting a bathing vessel may still present serious challenges merely due to the weight of the elderly or infirm individual. Therefore, various mechanical forms of bathing assistance have been developed to aid the elderly or infirm in the act of bathing. Without exception, however, these prior art devices suffer from various shortcomings.

The major shortcoming not addressed by the prior art is that when an elderly or infirm patient is lifted above the ground to allow the supporting structure to be placed in a bathtub, the vertical lifting action can cause anxiety or fear in the patient. This is especially true in dealing with very old patients who may already have a great fear of falling due to the brittle nature of their bones, be it real or perceived. Without exception, the prior art discloses bathtub lift systems which vertically lift the chair on which the patient is placed to allow the chair to enter the bathing vessel.

It has been found that the anxiety of an elderly or infirm patient may be greatly decreased if the vertical lifting action of the prior art is replaced by a tilt lift action where the base of the patient's chair is tilted upwards such that the patient may eventually be in a reclining position. There is therefore a need for such a tilt lift bathing system.

Known prior art apparatus for lifting a chair into a from a bathtub fail to teach the tilt lift bathing system of the present invention. For example, Dueth, U.S. Pat. No. 2,697,475, discloses an apparatus for lifting a chair into and from a bath tub, the apparatus including a parallelogram linkage connected to one side of the chair for simultaneously lifting and tilting the chair relative to the linkage. This mechanism, however, is designed for use at the middle of one side of the tub, rather than at the end, and the chair is never rolled upwardly to a position above the vertical pivot axis.

Grant, U.S. Pat. No. 3,879,770, is another example of the known prior art wherein the chair is lifted straight up, rotated into position above the tub and lowered. A patient using the Grant apparatus would thus experience great anxiety due to the vertical lifting process in a seated position, which is undesirable.

Therefore, an object of the present invention is to provide a tilt lift bathing system.

Another object of the present invention is to provide a tilt lift bathing system which tilts the seated patient upwards about a substantially horizontal pivot axis to provide clearance for rotation of the seated patient over the bathtub.

Yet another object of the present invention is to provide a tilt lift bathing system which will substantially reduces the risk of a patient falling from the chair when the chair is elevated above the bathtub.

A related object of the present invention is to provide a tilt lift bathing system which substantially eliminates or decreases the fear and anxiety experienced by persons lifted by the system of the present invention.

Finally, an object of the present invention is to provide a tilt lift bathing system which is durable in construction and safe in use.

SUMMARY OF THE INVENTION

The present invention provides an apparatus and method for assisting the elderly or infirm in a process of bathing. The apparatus consists of a base adapted to be mounted adjacent one wall of the bathtub on which is mounted a central support. The central support extends upwards from the base. Also included is a chair having a back portion and a seat portion. The chair is pivotably and rotatably mounted on the central support such that the human body support may rotate in a generally horizontal plane about a substantially vertical axis and may pivot in a generally vertical plane about a substantially horizontal axis, the horizontal pivot axis being adjacent the back portion of the human body support.

The chair is supported on the base for rotational movement about a substantially vertical rotational axis situated behind the back portion upon movement of the chair means to the lowered upright position thereof.

Finally, a power means is mounted on the base for pivoting the chair between the lowered upright position and raised recumbent position, whereby upon mounting the base adjacent one wall of the bathtub, the chair is pivotable upwardly to the raised recumbent position by the power means, rotatable over the one wall and pivotable downwardly by the power means to the lowered upright position in a tub for bathing an occupant of the chair.

The method of the present invention includes the steps of providing a chair which is mounted on a central support, the central support in turn mounted on a base adjacent one wall of a bathtub. A human body is supported by the chair. The chair is then pivoted upwards about a generally horizontal pivot axis from a lowered upright position exteriorly of one wall to a raised recumbent position above one wall. The chair is then rotated about a generally vertical rotational axis to a position above the bathtub. The chair is then pivoted downwards about the generally horizontal pivot axis to the lowered upright position within the tub to allow bathing of an occupant of the chair.

As was previously stated, patient's lifted by tilting tend to feel less anxiety than those lifted vertically by devices found in the prior art. The present invention as thus described is therefore superior to those devices found in the prior art.

DESCRIPTION OF THE PREFERRED EMBODIMENT

Figure 1:
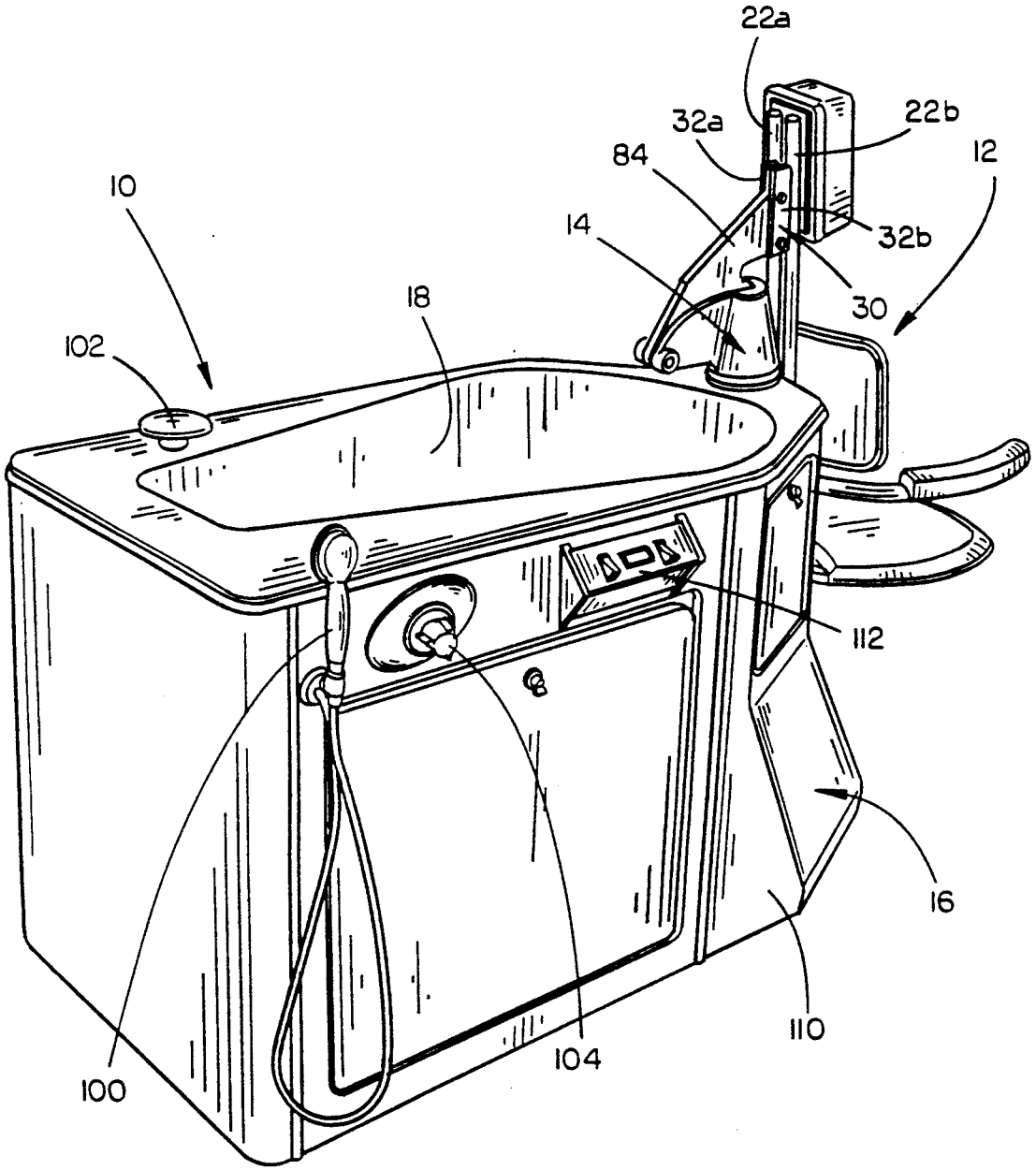
FIG. 1 is a perspective view of the tilt lift bathing system of the invention.
Figure 2:
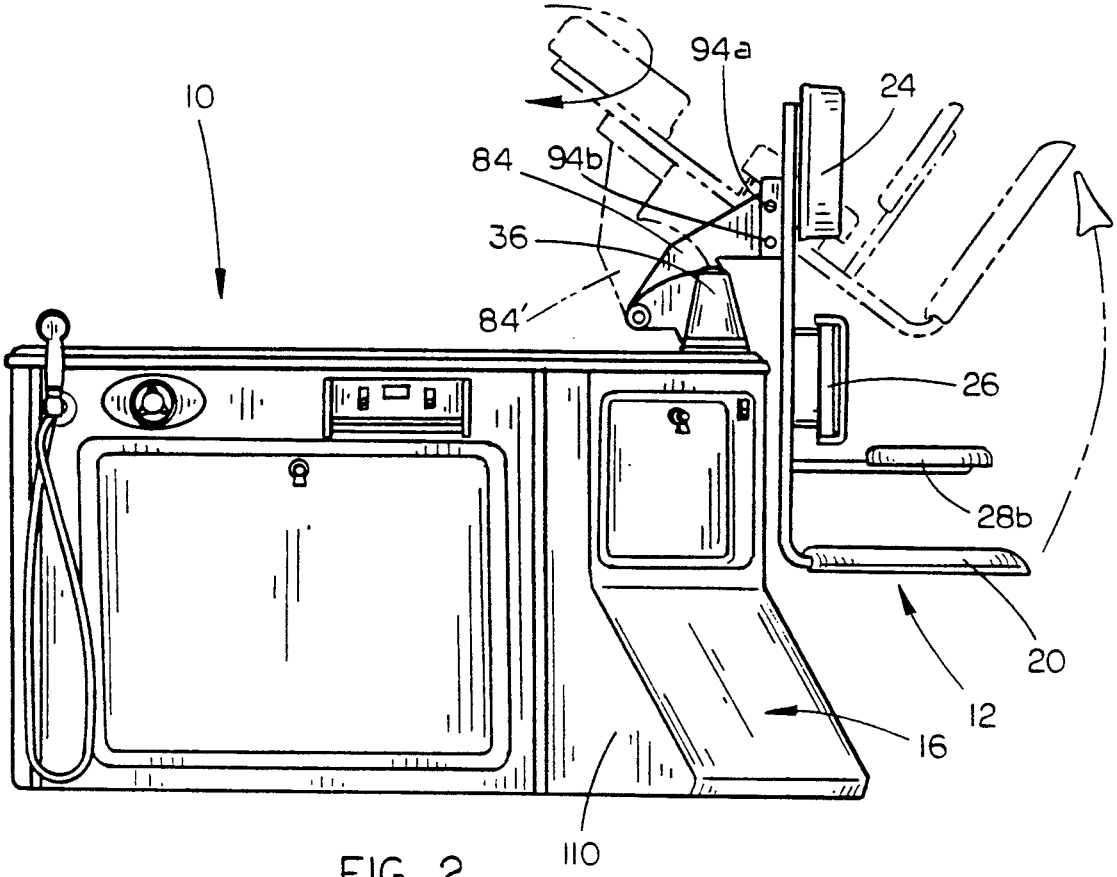
FIG. 2 is a side elevational view of the tilt lift bathing system showing the chair unit in both lowered and tilted position.

The tilt lift bathing system 10 of the present invention is illustrated in FIGS. 1 and 2 as including a chair 12 pivotally mounted on a central support 14, which in turn is rotatably mounted on a base 16. In the preferred embodiment the base 16 includes a bathtub 18 adjacent to which is mounted the central support 14.

The chair 12 is preferably constructed as having a rigid seat portion 20 which is mounted on a pair of upright seat back bars 22*a* and 22*b*. The seat portion 20 is generally perpendicular to the seat back bars 22*a* and 22*b*. Mounted on the seat back bars 22*a* and 22*b* are a headrest 24 and a middle back support 26. The headrest 24 and middle back support 26 provide support for the upper body of a person using the chair 12. Also mounted on the seat back bars 22*a* and 22*b* are a pair of arm rests 28*a* and 28*b*, provided for increased comfort for bathers using the tilt lift bathing system 10. In a preferred embodiment, the seat portion 20, headrest 24, middle back support 26 and arm rests 28*a* and 28*b* would all be padded with a waterproof padding material such as vinyl-covered foam or the like. Furthermore, it is preferred that the various elements of the chair 12 be constructed of a durable rigid material such as aluminum, particularly the seat back bars 22*a* and 22*b* which undergo the greatest amount of strain of any of the elements of the chair 12 when a person sits in the chair 12.

Mounted on the rear side of the seat back bars 22*a* and 22*b* is a connection bracket 30. The connection bracket 30 is preferably constructed of a pair of parallel plates 32*a* and 32*b*, one plate mounted to each seat back bar 22*a* and 22*b*. It is preferred that the connection bracket 30 be mounted to the seat back bars 22*a* and 22*b* towards the top of the seat back bars 22*a* and 22*b* thus placing the seat portion 20 closer to the ground and making it easier for an elderly or infirm patient to get into the chair 12. However, the exact location of the connection bracket 30 is not critical to the invention.

Figure 4:
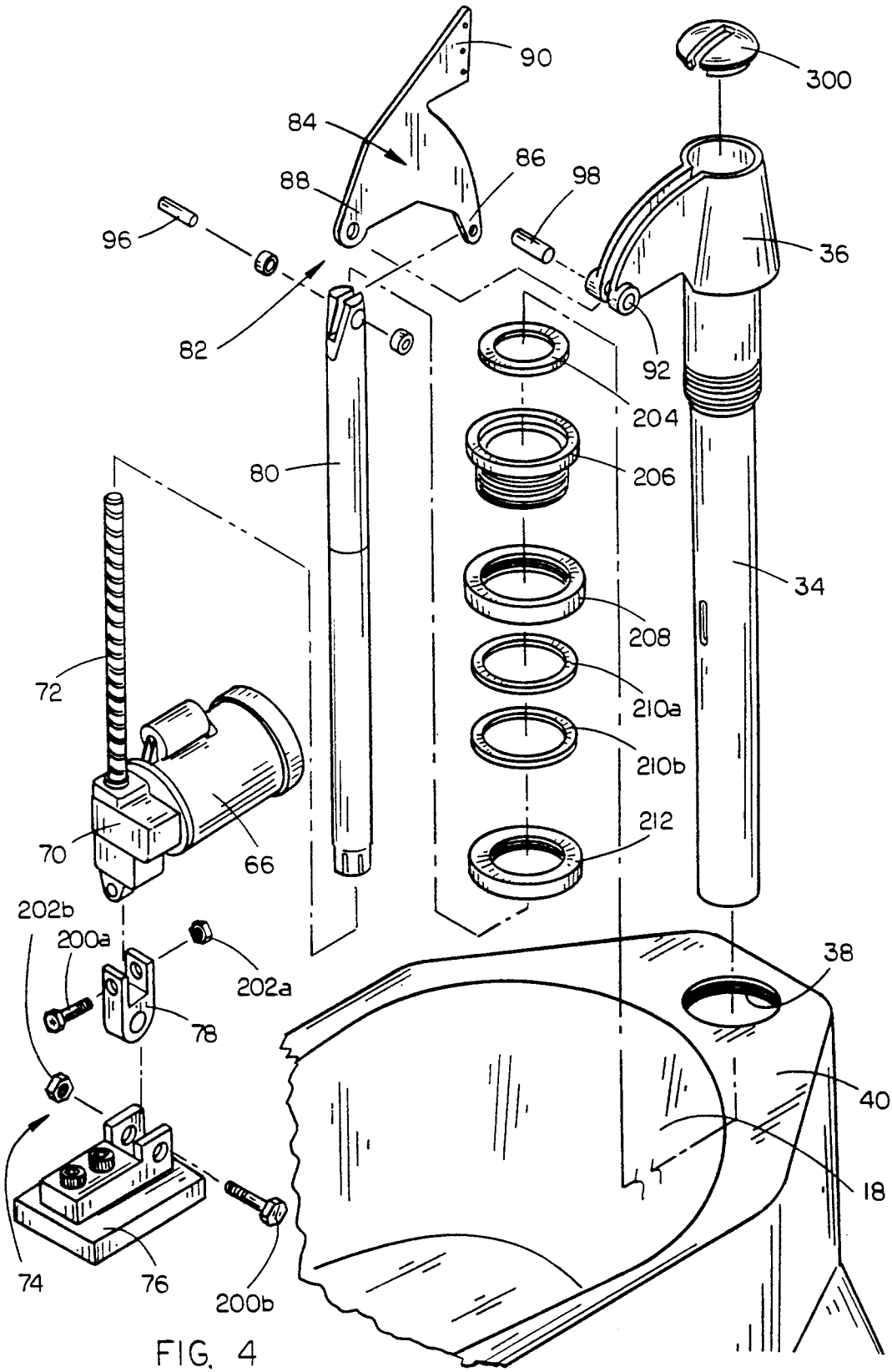
FIG. 4 is an exploded partial detail perspective view of the tilt lift mechanism for tilting the chair mounted thereon.
Figure 6:
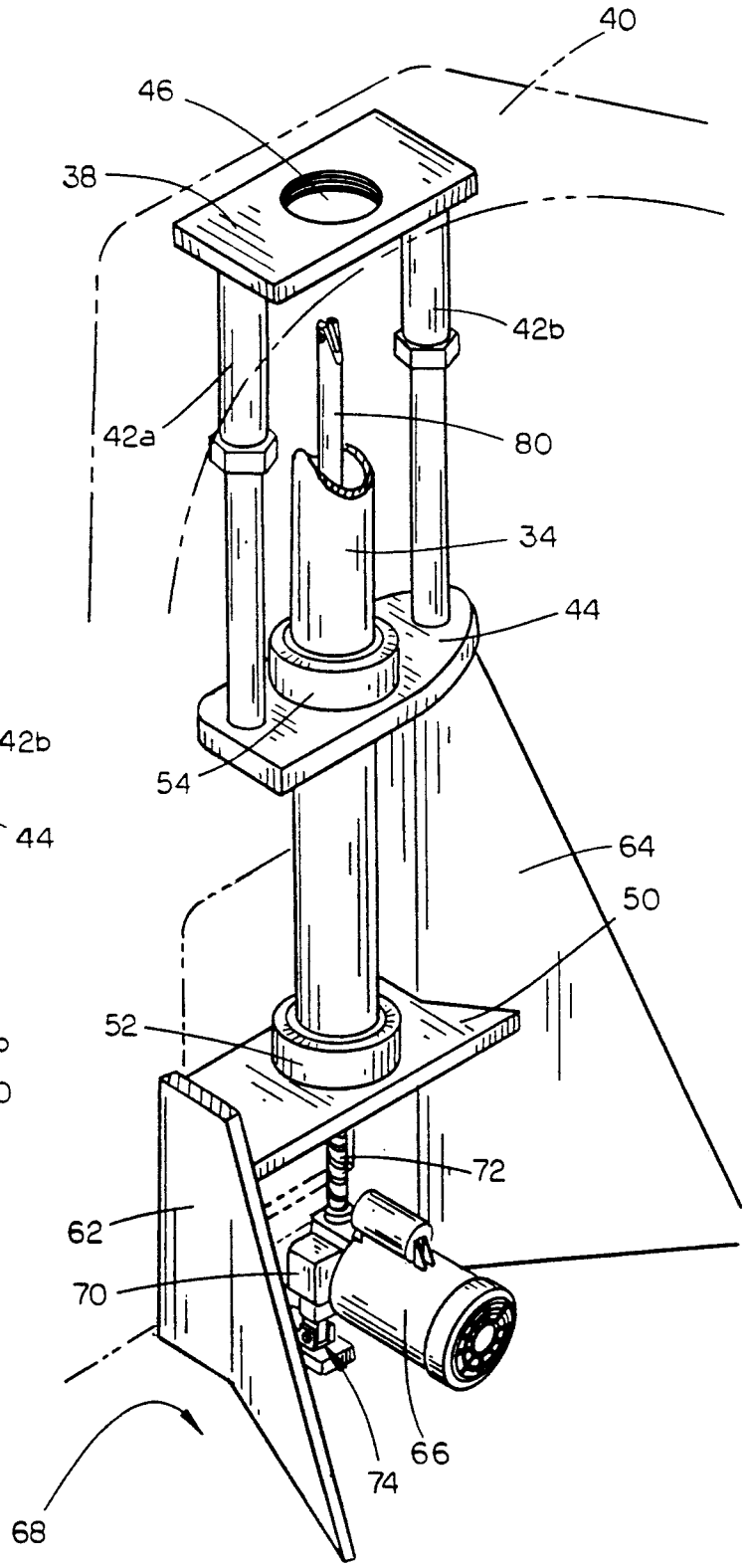
FIG. 6 is a sectional perspective view of the lifting apparatus of the invention with the bathtub represented by the dotted lines.
Figure 9:
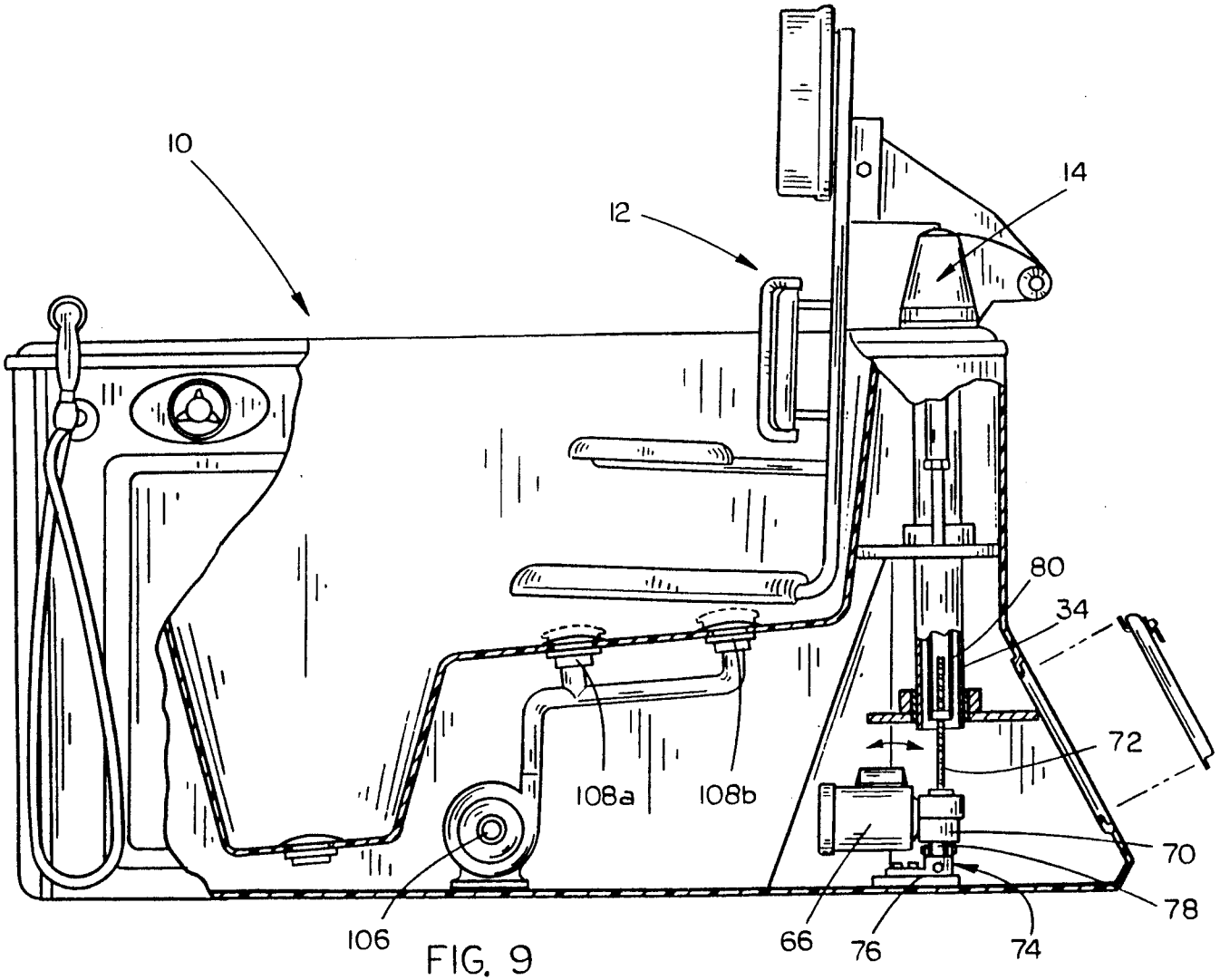
FIG. 9 is a side sectional view of an alternative embodiment of the invention having whirlpool jets in the bathtub and showing the pivoting action of the lifting motor.

The central support 14 is best shown in FIGS. 4, 6 and 9 as including a hollow shaft 34 to the top of which is mounted an offset pivot head 36, as shown in FIG. 4. The hollow shaft 34 is mounted on a section of the base 16 shown most clearly in FIG. 6 as including a generally horizontal mounting plate 38 mounted against the underside of the upper lip 40 of the bathtub 18. Depending from the mounting plate 38 are a pair of support columns 42*a* and 42*b* which extend downwards to a lower rotational restrictor plate 44. The mounting plate 38 and rotational restrictor plate 44 further include circular holes, 46 and 48 respectively, through which the hollow shaft 34 of the central support 14 extends. The hollow shaft 34 extends downwards through the circular hole 48 in the rotational restrictor plate 44 to a hollow shaft support plate 50, which is preferably positioned between 8 and 12 inches above the floor. The lower end of the hollow shaft 34 fits into a circular mounting recess 52 mounted on the upper surface of the hollow shaft support plate 50. The hollow shaft 34 is thus rotatably supported by the hollow shaft support plate 50.

Figure 5:
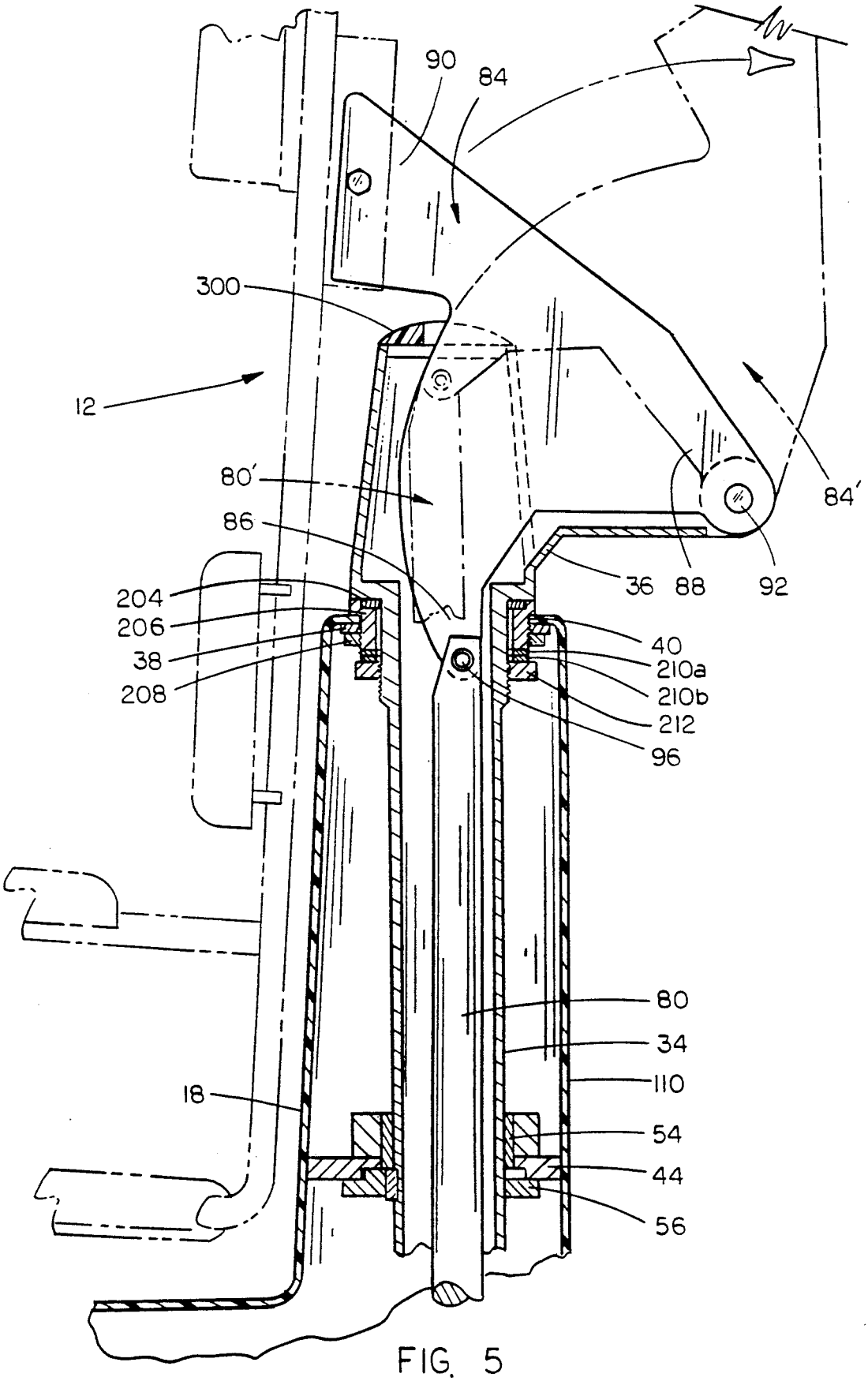
FIG. 5 is an enlarged side sectional view of the tilt mechanism of the tilt lift bathing system.

For securing the hollow shaft 34 to the mounting plate 38, various connector nuts and rings are preferably used to provide sufficient support to the chair 12. As shown in FIGS. 4 and 5, a bearing or seal ring 204 fits around the hollow shaft 34, the seal ring 204 seated in a threaded ring connector 206 which screws into the mounting plate 38. To secure the threaded ring connector in place, a threaded seat ring 208 screws onto the threaded ring connector below the mounting plate 38. A pair of lock rings 210*a* and 210*b* are then slid onto the hollow shaft 34 and positioned against the lower side of the threaded seat ring 208. Finally, to secure the hollow shaft 34 in place, a locking ring 212 is screwed onto the hollow shaft 34 and tightened against the lock rings 210*a* and 210*b*, thus securing the hollow shaft 34 in position yet allowing rotation thereof.

Figure 7:
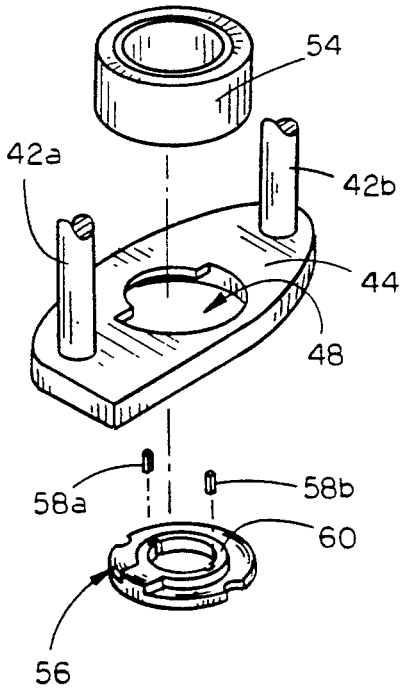
FIG. 7 is an enlarged sectional perspective view of the rotational restrictor of the invention which prevents the chair from rotating through more than 180°.
Figure 8:
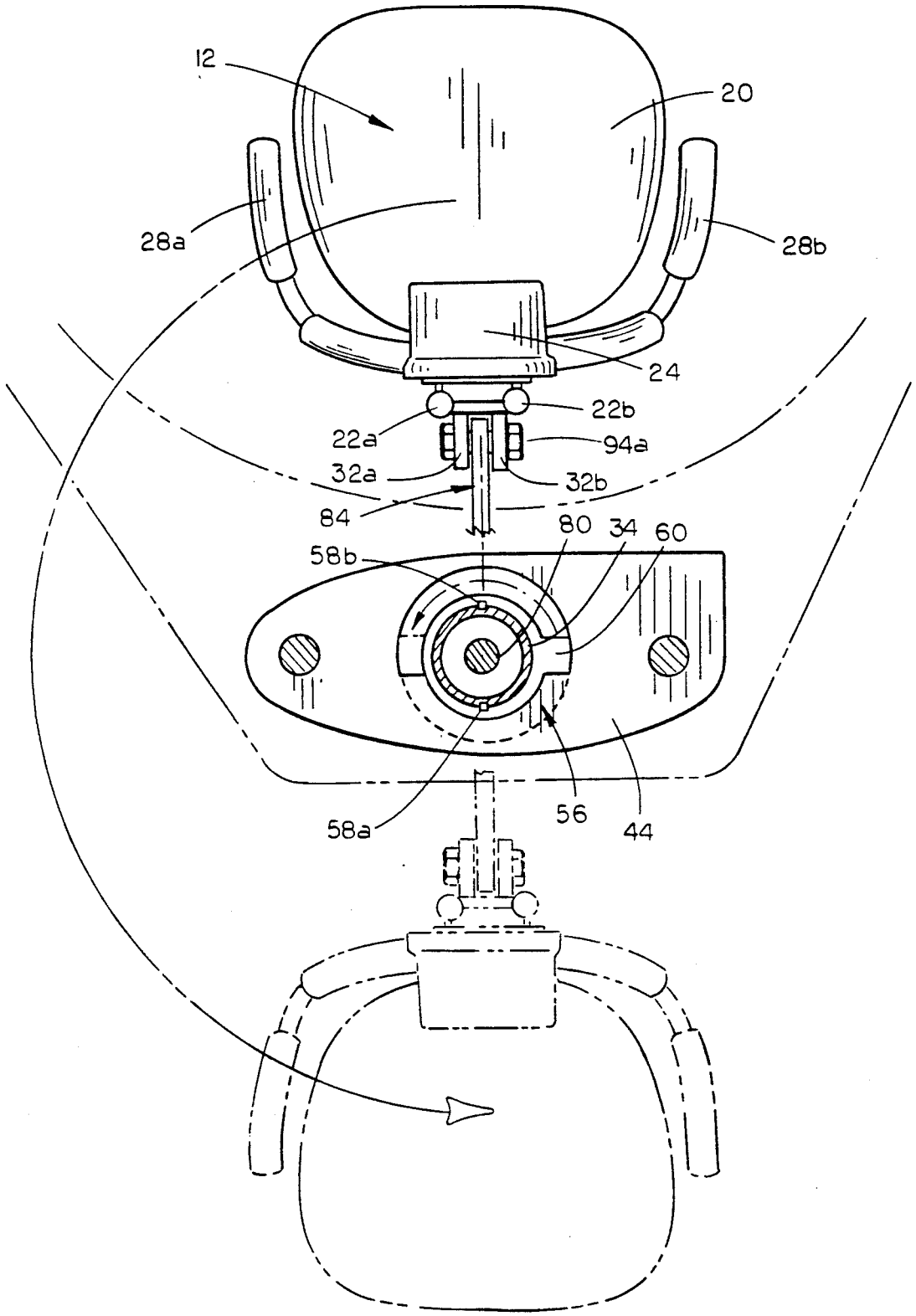
FIG. 8 is a top plan sectional view of the rotational restrictor of the invention showing the chair rotated through 180° (as shown by the dotted lines)

The rotational restrictor plate 44 is more clearly shown in FIG. 7 as including a hole 48 which is formed of a pair of adjoining semicircles of differing radii. A rotational restrictor sheath 54 fits over and around the hollow shaft 34 and rests atop the rotational restrictor plate 44. Slid over and onto the hollow shaft 34 underneath the rotational restrictor plate 44 is a rotational restrictor disk which extends into the hole 48 and is connected to the rotational restrictor sheath 54 by a pair of connector pins 58*a* and 58*b*. To operate correctly, the rotational restrictor sheath 54 and rotational restrictor disk 56 must be connected to the outer surface of the hollow shaft 34 such that rotation of the hollow shaft 34 causes rotation of the rotational restrictor sheath 54 and rotational restrictor disk 56. As best seen in FIG. 7, an upwardly extending disk section 60 extends upwards through the hole 48 in the rotational restrictor plate 44 such that the disk section 60 prevents rotation of the hollow shaft 34 through more than 180°. The rotational movement of the hollow shaft 34, and thus the chair 12, is restricted, as shown in FIG. 8.

The hollow shaft support plate 50 extends substantially horizontally between and is rigidly connected to a pair of generally triangular buttresses 62 and 64 which also are connected to and provide additional support for the rotational restrictor plate 44. This structure as thus defined provides the majority of support for the chair 12. It is preferred that the above-mentioned elements be constructed of a high-tensile steel or the like for structural soundness.

Mounted directly beneath the hollow shaft support plate 50 is a reversible electric motor 66 which is pivotably mounted on the ground engaging base 68 of the tilt lift bathing system 10. Connected to the output shaft of the reversible electric motor 66 is a reduction gearbox 70 which houses a set of reducing gears (not shown). The output of the reduction gearbox 70 is a screw drive 72 which is preferably an 8 pitch screw, as shown in FIG. 4. The opposite end of the reduction gearbox 70 is pivotally mounted to the ground engaging base 68 by a pivot joint assembly 74 which includes a base 76 on which is mounted a U-shaped pivot joint 78, as shown in FIG. 4. For connecting the elements of the pivot joint assembly 74, pivot bolts 200*a* and 200*b* and pivot nuts 202*a* and 202*b* are provided, though any suitable connection means may be used. The reversible electric motor 66, reduction gearbox 70 and screw drive 72 may thus pivot in two directions to alleviate stress placed on the screw drive 72, as shown in FIG. 9. The purpose for the reduction gearbox 70 is to convert the high-speed, low-torque output of the electric motor 66 to a relatively low-speed, high-torque rotation of the screw drive 72 about the screw drive's center longitudinal axis.

Threadably mounted on the screw drive 72 is an interiorly threaded upright hollow lifting shaft 80 which extends upwards through the center of the hollow shaft 34. The upright hollow lifting shaft 80 is mounted such that vertical movement of the lifting shaft 80 is allowed but rotational movement of the lifting shaft 80 about its center longitudinal axis is prevented. The interior threads in the upright lifting shaft 80 coact with the screw drive 72 such that rotation of the screw drive 72 causes upward extension or downward retraction of the opposite end of the lifting shaft 80. It is preferred that the screw drive 72 be mounted within the upright hollow lifting shaft 80 such that the screw drive 72 is incapable of disengaging from the interior of the upright hollow lifting shaft 80.

The chair pivot mechanism 82 has as its main element a generally triangular pivot plate 84, best shown in FIG. 4. The pivot plate 84 preferably has three corner areas 86, 88 and 90, the first corner area 86 being pivotally connected to the top end of the lifting shaft 80. The second corner area 88 is preferably connected to the pivot point 92 of the offset pivot head 36 atop the hollow shaft 34. The pivot plate 84 thus sits within the offset pivot head 36. The third corner area 90 is rigidly connected to the connection bracket 30 extending between the parallel plates 32*a* and 32*b* and is secured there by bolts 94*a* and 94*b*. It is preferred that the pivot connections at the first corner area 86 and second corner area 88 of the pivot plate 84 be connected as shown in FIG. 4 to, respectively, the top end of the hollow lifting shaft 80 and the pivot point 92 of the offset pivot head 36 by pin and socket connectors 96 and 98. For sealing the open end of the hollow shaft 34, a top cap 300 may be provided as shown in FIG. 4. It is preferred that the pivot plate 84 be constructed of a very strong material, such as aircraft aluminum or carbon stainless steel, as the pivot plate 84 must endure a great deal of stress.

Figure 3:
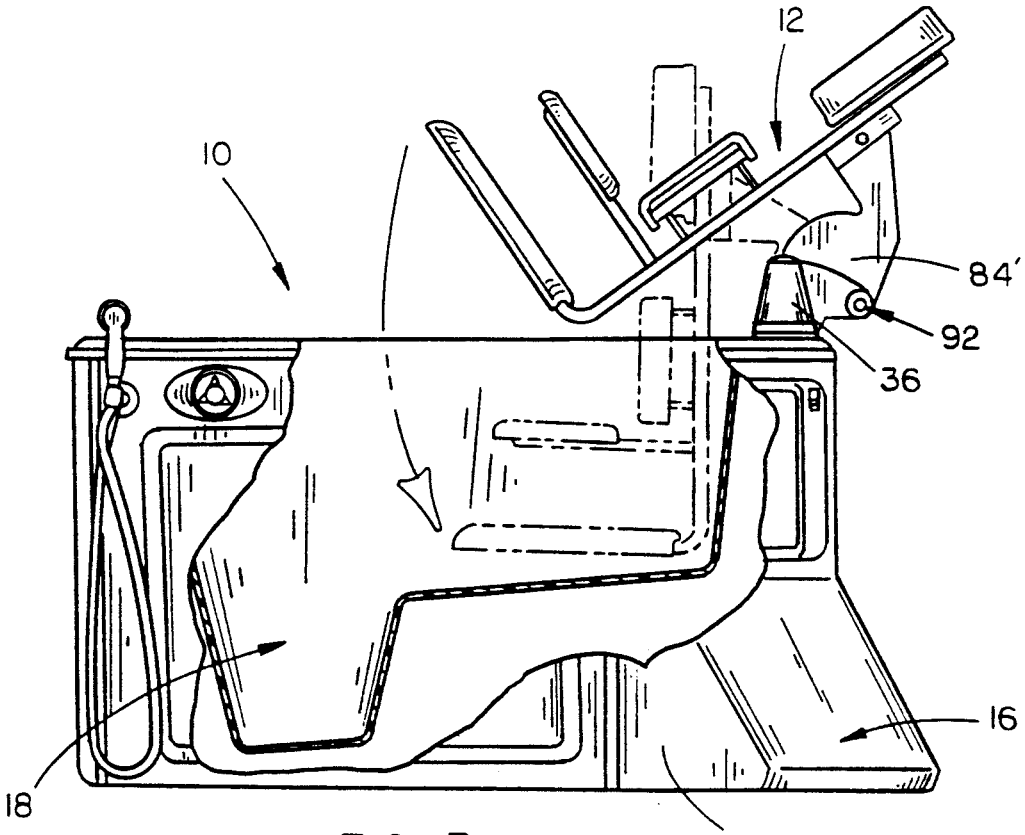
FIG. 3 is a side elevational view of the tilt lift bathing system with portions cut away to expose the bottom contour of the bathtub and the chair placed within the bathtub.

All of the above described elements work together to pivot the chair 12 upwards thus allowing the chair 12 to clear the upper lip 40 of a bathtub 18. The pivoting mechanism functions in the following manner. Engagement of the reversible electric motor 66 causes rotation of the gears in the reduction gearbox 70 thus rotating the screw drive 72 about its center longitudinal axis. The reversible electric motor 66 allows the screw drive 72 to rotate both clockwise and counter-clockwise. Rotation of the screw drive 72 causes vertical extension or retraction of the upright hollow lifting shaft 80 due to the interior threading of the lifting shaft 80 coacting with the threads on the screw drive 72. As the upright hollow lifting shaft 80 extends upwards from its rest position, shown in FIG. 5, the lifting shaft 80 urges the pivot plate 84 upwards due to the pivotal connection of the lifting shaft 80 and pivot plate 84 at the first corner area 86. This upwards force causes the pivot plate 84 to pivot about the second corner area 88 which is connected to the pivot point 92 on the offset pivot head 36. As a result of this pivoting motion, the third corner area 90 which is connected to the connection bracket 30 on the chair 12 is pivoted upwards as shown in FIG. 3 and by the dotted lines in FIG. 5. The upright hollow lifting shaft 80 extends upwards to a fully extended position 80', shown in FIG. 5, thus pivoting the pivot plate 84 into a likewise fully extended position 84'. Once the chair 12 is in a raised recumbent position, shown by the dotted lines in FIG. 2 and solid lines in FIG. 3, the chair may be pivoted as shown in FIG. 8 to a position above the bathtub 18. The electric motor 66 may then be reversed, thus reversing the extension process and lowering the chair back to a rest position within the bathtub 18 (as shown by the dotted lines in FIG. 3).

It is preferred that the bathtub 18 be substantially as shown in FIGS. 1 and 9 as including a shower head 100, whirlpool inlet 102, whirlpool air control 104 and whirlpool pump 106 and jets 108*a* and 108*b*. For mainly aesthetic reasons, the tub outer shell 110 is provided having various access doors for simplifying repairs. Also provided are the on/off switches for the whirlpool pump 106 and electric motor 66, shown by the control panel 112.

Also included in the invention is a method of providing assistance in bathing a human body. The method includes the steps of providing an apparatus as described above and supporting a human body by the chair 12. The chair 12 would then be pivoted about the pivot point 92 on the offset pivot head 36 from a lowered upright position exteriorly of one wall of the bathtub 18 to a raised recumbent position above one wall of the bathtub 18 such that the chair 12 may be entirely above the upper lip 40 of the bathtub 18. The chair 12 is then rotated about the center longitudinal axis of the hollow shaft 34 as the hollow shaft 34 is rotatably mounted in the circular mounting recess 52 in the hollow shaft support plate 50. Rotation of the chair 12 is restricted by the rotational restrictor plate 44 and accompanying rotational restrictor disk 56 mounted on the hollow shaft 34. Once the chair 12 is positioned over the bathtub 18, the chair is then pivoted downwards about the pivot point 92 on the offset pivot head 36 to a lowered upright position thus placing the chair 12 within the bathtub 18. The occupant of the chair 12 thus may be bathed through use of either the shower head 100, whirlpool jets 108*a* and 108*b* or other bathing means. It is preferred that the rotating of the chair 12 be performed manually by a person assisting the patient who is being bathed. Alternatively, of course, the rotation of the chair 12 may be accomplished by attaching a power device to the hollow shaft 34 or any other means which would be apparent to one skilled in the art. For simplicity, however, it is preferred that the rotating of the chair 12 be done manually.

The invention as thus described provides a substantial improvement over the prior art. As a patient is tilted onto his or her back to allow the chair 12 to be placed within the bathtub 18, the patient feels more secure within the chair 12 and anxiety or fear caused by being above the ground is greatly reduced. Also, as the vertical rotational axis shown by the hollow shaft 34, is centered on the patient's back when the chair 12 is in raised recumbent position, shown by the dotted lines in FIG. 2, the patient will be subjected to substantially less centrifugal force than that encountered in using devices found in the prior art, and thus experience less anxiety. Furthermore, as the number of moving parts of the invention is less than many other examples found in the prior art, the need for repairs may be reduced.

While the invention has been described with a high degree of particularity, it will be appreciated by those skilled in the art that numerous modifications and substitutions may be made to the tilt lift bathing system of the present invention. For example, the dimensions and components of the chair 12 may be changed as well as the dimensions and components of the bathtub and other elements of the invention. Whereas pivot plate 84 is described as generally triangular with corner areas 86, 88 and 90, it is understood that reference numerals 86, 88 and 90 alternately may be any generally triangularly spaced connection points on a pivot plate having any noninterfering peripheral shape. Therefore, it is to be understood that the above description is not intended in any way to limit the scope of the present invention which shall follow from the claims set forth below.

There has thus been set forth and described an invention which accomplishes at least all of the stated objectives.

I claim:

1. A tilt lift bathing system for supporting and lifting an individual into and from a bathtub having at least one wall with interior and exterior surfaces, comprising:

a base adapted to be mounted adjacent said one wall of said bathtub;

central support means mounted on and extending upwards from said base;

chair means having a back portion and a seat portion;

said chair means being mounted on said central support means for pivotal movement about a generally horizontal pivot axis between a lowered upright position adjacent either said interior or said exterior surface of said bathtub and a raised recumbent position above said central support means;

said chair means being supported on said base for rotational movement about a substantially vertical rotational axis situated behind said back portion thereof for pivoting said chair means about said substantially vertical axis; and power means on said base for pivoting said chair means between said lowered upright positions and said raised recumbent position, whereby upon mounting of said base adjacent one wall of a bathtub, said chair means is pivotable upwardly adjacent from said exterior surface to the raised recumbent position by said power means, rotatable over said said one wall toward the bathing cavity of said bathtub and pivotable downwardly by said power means to the lowered upright position adjacent said interior surface of the tub for bathing an occupant of said chair means.

2. The tilt lift bathing system of claim 1 wherein said central support means comprises a substantially upright hollow shaft having a generally horizontal pivot axis pin mounted adjacent the top of said shaft for connection to said chair means.

3. The tilt lift bathing system of claim 2 wherein said chair means comprises a chair having a substantially horizontal seat portion and generally upright back portion, said back portion further comprising a connection bracket mounted on the rear side of said back portion.

4. The tilt lift bathing system of claim 3 wherein said power means for pivoting said chair about said substantially horizontal pivot axis comprises a reversible screw drive mechanism and an interiorly threaded upright lifting shaft threadably and movably mounted on said screw drive mechanism such that engagement of said reversible screw drive mechanism is operative to upwardly extend or downwardly retract said lifting shaft.

5. The tilt lift bathing system of claim 4 further comprising a generally triangular pivot plate having three corner areas, a first corner area pivotally connected to the top of said lifting shaft, a second corner area pivotally connected to said generally horizontal pivot axis pin of said central support means and a third corner area rigidly connected to said connection bracket of said chair means, whereby extension of said lifting shaft pivots said chair means about said generally horizontal pivot axis pin thereby elevating said chair means.

6. The tilt lift bathing system of claim 1 wherein said central support means further comprises a rotation limiting device such that said chair means may rotate about said substantially vertical axis in an arc of not more than 180°.

7. The tilt lift bathing system of claim 5 wherein said screw drive mechanism further comprises a reversible electric motor having an output shaft connected to a gearbox having gears therein, said gearbox connected to an upright threaded rod onto which said lifting shaft is threaded whereby engagement of said electric motor rotates said gears in said gearbox, thus rotating said threaded rod and extending or retracting said lifting shaft.

8. The tilt lift bathing system of claim 7 wherein said electric motor is pivotably mounted on said base and beneath said central support means whereby said lifting shaft may extend upwards within said hollow shaft.

9. The tilt lift bathing system of claim 2 wherein said substantially vertical rotational axis extends substantially coaxially with the center longitudinal axis of said hollow shaft.

10. The tilt lift bathing system of claim 3 wherein said generally horizontal pivot axis is spaced rearwardly behind said back portion of said chair upon movement of said chair to the lowered upright position, said vertical rotational axis being interposed between said horizontal pivot axis and said back portion.

11. A method of providing assistance in bathing a human body comprising;

a bathtub having at least one wall with interior and exterior surfaces;

providing chair means mounted on a central support means, said central support means in turn mounted on a base, said base adjacent said one wall of said bathtub;

supporting said human body by said chair means;

pivoting said chair means upwards about a generally horizontal pivot axis from a lowered upright position exteriorly of said one wall to a raised recumbent position above said central support means;

rotating said chair means about a generally vertical rotational axis, over said one wall toward the bathing cavity of said bathtub; and pivoting said chair means downwards about said generally horizontal pivot axis to a lowered upright position adjacent said interior surface of the tub to allow bathing of an occupant of said chair means.

12. The method of claim 11 further including providing said chair means with a back portion and a seat portion, said chair means pivotably and rotatably mounted on said central support means such that said chair means may rotate in a generally horizontal plane about a substantially vertical axis and may pivot in a generally vertical plane about a substantially horizontal axis, said horizontal pivot axis adjacent said back portion of said chair means.

13. The method of claim 12 wherein said step of pivoting said chair means about a generally horizontal pivot axis further comprises providing a reversible power means for pivoting said chair means about said substantially horizontal rotational axis between a lowered upright position adjacent either said interior of said exterior surface of said bathtub and a raised recumbent position above said central support means whereby said chair means may be pivoted upwards such that the entire chair means is above said one wall of said bathtub.

14. The method of claim 12 wherein said step or rotating said chair means about a generally vertical rotational axis further includes an operator swinging said chair means through an arc due to force applied by said operator.

15. A tilt lift bathing system for supporting and lifting an individual into and from a bathtub, comprising;

a bathtub having at least one wall with interior and exterior surfaces;

a base adapted to be mounted adjacent said one wall of said bathtub;

central support means mounted on and extending upwards from said base;

chair means having a back portion and a seat portion;

said chair means being mounted on said central support means for pivotal movement about a generally horizontal pivot axis between a lowered upright position adjacent either said interior or said exterior surface of said bathtub and a raised recumbent position above said central support means;

said chair means being supported on said base for rotational movement about a substantially vertical rotational axis situated behind said back portion thereof for pivoting said chair means about said substantially verticle axis; and power means on said base for pivoting said chair means between said lowered upright positions and said raised recumbent position, whereby upon mounting of said base adjacent one wall of a bathtub, said chair means is pivotable upwardly adjacent from said exterior surface to the raised recumbent position by said power means, rotatable over said one wall toward the bathing cavity of said bathtub and pivotable downwardly by said power means to the lowered upright position adjacent said interior surface of said tub for bathing an occupant of said chair means.

16. The tilt lift bathing system of claim 15 wherein said bathtub is a standard bathtub to which said tilt lift bathing system is added on, whereby said tilt lift bathing system is not an integral part of said bathtub.

17. The tilt lift bathing system of claim 15 wherein said bathtub is formed as an integral part of said tilt lift bathing system such that an integral washing unit is formed which may provide additional stability.

18. The tilt lift bathing system of claim 15 wherein said central support means is adjacent to and extends upwards through one wall of said bathtub whereby said chair means may be positioned to pivot and rotate into and from said bathtub.

* * * * *